US007959546B2

(12) United States Patent
Patel et al.

(10) Patent No.: US 7,959,546 B2
(45) Date of Patent: Jun. 14, 2011

(54) OIL CENTRIFUGE FOR EXTRACTING PARTICULATES FROM A CONTINUOUS FLOW OF FLUID

(75) Inventors: Vipul P. Patel, Irvine, CA (US); Allen K. MacKnight, Signal Hill, CA (US)

(73) Assignee: Honeywell International Inc., Morristown, NJ (US)

( * ) Notice: Subject to any disclaimer, the term of this patent is extended or adjusted under 35 U.S.C. 154(b) by 1177 days.

(21) Appl. No.: 11/626,476

(22) Filed: Jan. 24, 2007

(65) Prior Publication Data

US 2008/0173592 A1 Jul. 24, 2008

(51) Int. Cl.
*B04B 9/06* (2006.01)

(52) U.S. Cl. ..... 494/49; 494/67; 494/79

(58) Field of Classification Search ..... 494/24, 494/36, 43, 49, 56, 64, 65, 67, 83, 84, 901, 494/60, 74, 79; 210/168, 171, 232, 360.1, 210/380.1, 416.5; 184/6.24
See application file for complete search history.

(56) References Cited

U.S. PATENT DOCUMENTS

| | | | | |
|---|---|---|---|---|
| 2,053,856 | A | 11/1936 | Weidenbacker | |
| 2,321,144 | A * | 6/1943 | Jones | 494/15 |
| 2,335,420 | A | 11/1943 | Jones | |
| 2,755,992 | A * | 7/1956 | Tait et al. | 494/49 |
| 3,730,422 | A * | 5/1973 | Cho | 494/74 |
| 4,557,831 | A | 12/1985 | Lindsay et al. | |
| 5,096,581 | A | 3/1992 | Purvey | |
| 5,785,849 | A | 7/1998 | Mules | |
| 6,017,300 | A * | 1/2000 | Herman | 494/49 |
| 6,019,717 | A * | 2/2000 | Herman | 494/49 |
| 6,183,407 | B1 * | 2/2001 | Hallgren et al. | 494/49 |
| 6,200,252 | B1 * | 3/2001 | Hallgren et al. | 494/49 |
| 6,224,531 | B1 * | 5/2001 | Frehland et al. | 494/49 |
| 6,261,455 | B1 | 7/2001 | Brown et al. | |
| 6,296,765 | B1 | 10/2001 | Brown et al. | |
| 6,984,200 | B2 * | 1/2006 | Samways | 494/49 |
| 2001/0012814 | A1 | 8/2001 | May et al. | |
| 2005/0121262 | A1 | 6/2005 | Berger et al. | |
| 2008/0173592 | A1 * | 7/2008 | Patel et al. | 210/787 |
| 2009/0137376 | A1 * | 5/2009 | Patel et al. | 494/37 |

FOREIGN PATENT DOCUMENTS

| | | | |
|---|---|---|---|
| DE | 202004017820UU1 | | 3/2006 |
| EP | 1066884 | A2 | 1/2001 |
| EP | 1277515 | A2 | 1/2003 |
| GB | 745377 | A | 2/1956 |
| RU | 1831375 | A3 * | 7/1993 |
| WO | WO 02/45864 | A1 | 6/2002 |
| WO | WO 2004/101159 | A2 | 11/2004 |

OTHER PUBLICATIONS

European Patent Office, European Search Report, May 20, 2008, pp. 1-4, Munich, Germany.

* cited by examiner

*Primary Examiner* — Charles E Cooley
(74) *Attorney, Agent, or Firm* — Robert Desmond, Esq.

(57) ABSTRACT

A centrifuge is employed to continuously remove particulates from a fluid. In one embodiment, the centrifuge removes small particles of soot from lubricating oil of large diesel engines. The fluid in introduced into the centrifuge through an inducer so that vortexes are not propagated in the fluid. Flow constrainers and flow straighteners maintain laminar flow of the fluid as it passes axially through the centrifuge. An exducer decelerates the fluid prior to its exit from the centrifuge. The exducer thus contributes to maintaining laminar flow conditions. Laminar flow may contribute to the soot-removal effectiveness of the centrifuge.

11 Claims, 6 Drawing Sheets

OIL CENTRIFUGE FOR EXTRACTING PARTICULATES FROM A CONTINUOUS FLOW OF FLUID

BACKGROUND OF THE INVENTION

The present invention is in the field of centrifuges and, more particularly, centrifuges employed to remove particulates from lubricants.

Centrifuges have often been employed to remove various particulate contaminants from lubricating oil of internal combustion engines. The most common applications of centrifuges in this context have been in large diesel engines. Typically, lubricating oil of a large diesel engine may be continuously passed through a full flow filter and through a bypass centrifugal filter or centrifuge. While conventional centrifugal filters may be relatively costly, their cost is justified because engine life is improved when they are used.

Recent developments in environmental standards have introduced additional demands on filtering systems for diesel engine oil. Injector timing retardation is needed to meet more stringent air pollution standards. This results in increased production of carbon soot on the cylinder walls of an engine. Soot finds its way into the lubricating oil of the engine. Conventional full flow filters and conventional centrifugal filters do not adequately remove soot from the oil. Engine life is reduced in the presence of soot in the oil because the soot is abrasive and it reduces lubricating qualities of the oil.

Various efforts have been made to improve performance of centrifuges in attempts to introduce soot removal capabilities. Some examples of these efforts are illustrated in U.S. Pat. No. 6,019,717, issued Feb. 1, 2000 to P. K. Herman and U.S. Pat. No. 6,984,200 issued Jan. 10, 2006 to A. L. Samways. Each of these designs is directed to a problem of removing very small particles of soot, i.e., particles of about 1 to about 2 microns. Centrifuges separate particulates from fluids by exposing the particulates to centrifugal forces. Particulates with a density greater than the fluid are propelled through the fluid radially outward. But, in the case of soot particles suspended in oil, separation is difficult because soot particles have a density very similar to oil. Consequently, very high centrifugal forces may be required to move the soot particles through oil. Typically centrifugal forces of about 10,000 g's may be needed. These high forces may be produced by rotating a centrifuge at very high speeds. Alternatively, the requisite high g forces may be produced within a centrifuge having a very large diameter. However, as a practical matter, it is desirable to limit the diameter of a centrifuge to diameter of about 7 to 10 inches to meet space limitation on a vehicle and to limit rotational inertial effects. Also there is a practical limitation on the rotational speed that can be imparted to a centrifuge. Speeds of about 10,000 to about 12,000 rpm represent the limits of the current state of the art.

In attempts to capture small soot particles within these practical speed and size parameters, prior art centrifuges employ complex and labyrinth-like oil passage pathways. As oil traverses these complex pathways, it remains in a centrifuge for a relatively long time. In other words, it has an extended "residence time". It has heretofore been assumed that improved soot removal is directly related to increased residence time.

But, in various efforts to increase residence time, prior art centrifuges have employed oil passage pathways that introduce multiple changes in direction of flow of oil. Many of these changes in flow direction may be abrupt. As oil flow makes these abrupt changes in direction, vortexes may be generated. These vortexes may propagate throughout the entire mass of oil that may be present in a prior art centrifuge. This may result in oil flow that is turbulent in nature. Turbulence in oil flow may produce additional difficulty in removing small particles from the oil. Whenever any one particle is propelled outwardly by centrifugal force in a turbulent flow, there is a high probability that the particle will encounter a reverse flow of oil in a vortex. Such a reverse flow may propel the particle inwardly and thus cancel the desired effects of centrifugal force imparted by the centrifuge. Thus, the particle has a high probability of remaining suspended in the oil.

It can be seen that soot removal effectiveness of centrifuges in the present state of the art is bounded by various limiting conditions. First there is a practical limit on a diameter of a centrifuge. Secondly there is a practical limit on the rotational speed at which a centrifuge may be operated. And thirdly, increased residence times may be attained at the cost of producing turbulent flow in a centrifuge. As described above, turbulent flow may offset or cancel any beneficial effects of increasing residence time.

There has been no recognition in the prior art of a simple expedient to increase the soot removal effectiveness of centrifuges within the practical limits of centrifuge size and rotational speed. As can be seen, an improvement of soot removal effectiveness in a practical centrifuge would be desirable.

SUMMARY OF THE INVENTION

In one aspect of the present invention a centrifuge for extracting particulates from a continuous flow of fluid comprises a rotor, a passage for constraining at least a portion of the flow of the fluid as laminar flow. The passage is adapted to direct the laminar flow orthogonally to centrifugal forces imparted to the fluid by rotation of the rotor.

In another aspect of the present invention a centrifuge adapted to capture soot from lubricating oil comprises a rotor with a laminar flow passage therein. The laminar flow passage is oriented parallel to an axis of rotation of the rotor.

In still another aspect of the present invention a method for removing particulates from a fluid comprises the steps of producing a laminar flow of the fluid and imparting centrifugal force on the fluid in a direction orthogonal to a direction of the laminar flow of the fluid to capture the particulates from the fluid.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, the present invention may be useful in improving effectiveness of particulate removal of a centrifuge. More particularly, the present invention may provide a simple expedient to improve soot removal effectiveness that can be applied to a centrifuge that is operated and constructed within the bounds of practical size and speed of conventional centrifuges.

In contrast to prior art centrifuges, among other things, the present invention may provide a centrifuge that operates with a fluid flow therethrough which is laminar, i.e. non-turbulent. A desirable improvement of soot-removal effectiveness may achieved by constructing a centrifuge in an inventive configuration illustrated in FIG. 1.

Figure 1:
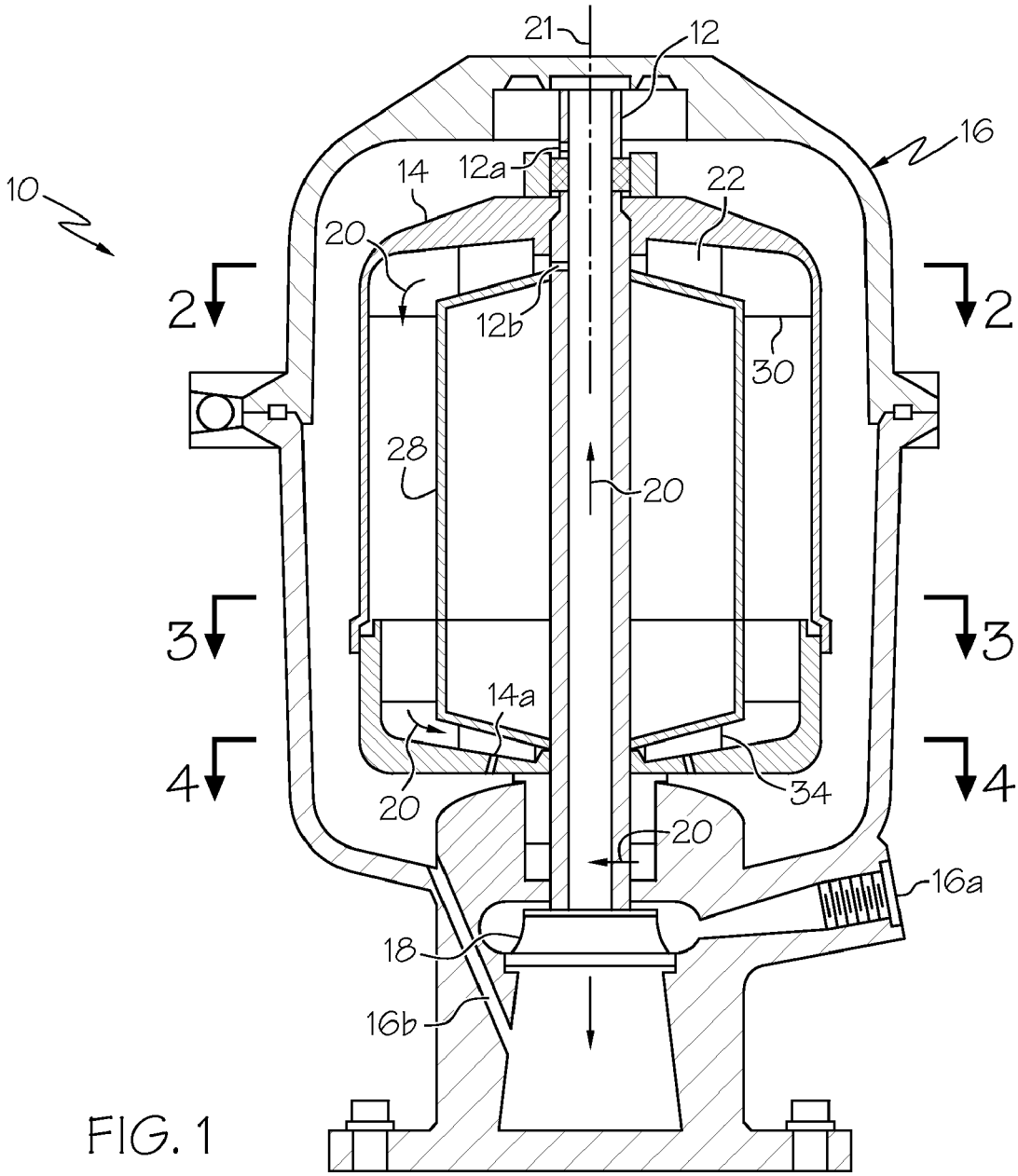
FIG. 1 is partial cross sectional view of a centrifuge constructed in accordance with the invention.

Referring now to FIG. 1, there is shown a sectional view of a centrifuge 10. The centrifuge 10 may be comprised of a spindle 12, a rotor 14, a housing 16 and a driving device, such as a turbine 18. A fluid such as lubricating oil may be introduced under pressure into a fluid inlet 16*a* to impinge on and rotate the turbine 18. The turbine 18 and the rotor 14 may be attached directly to the spindle 12. Thus the rotor 14 may be rotated by the turbine 18. A portion, about 10% to about 15%, of the fluid introduced into the inlet 16*a* may bypass the turbine 18 and enter a hollow passageway 12*a* of the spindle 12. The bypassed fluid may flow through a spindle passageway 12*a* and into the rotor 14. The bypassed fluid is indicated by arrows 20.

The fluid 20 may exit the spindle passageway 12*a* at spindle exit ports 12*b*. The fluid 20 may then continue into the rotor 14 and proceeds to rotor exit ports 14*a*. The fluid 20 may then proceed into the housing 16 through a return drain 16*b*. As the bypassed fluid 20 flows through the rotor 14, the fluid 20 may be subjected to centrifugal forces generated by rotation of the rotor 14 about a centrifuge axis 21. The centrifugal forces are applied to the fluid 20 in a direction that is orthogonal to the axis 21.

Figure 2:
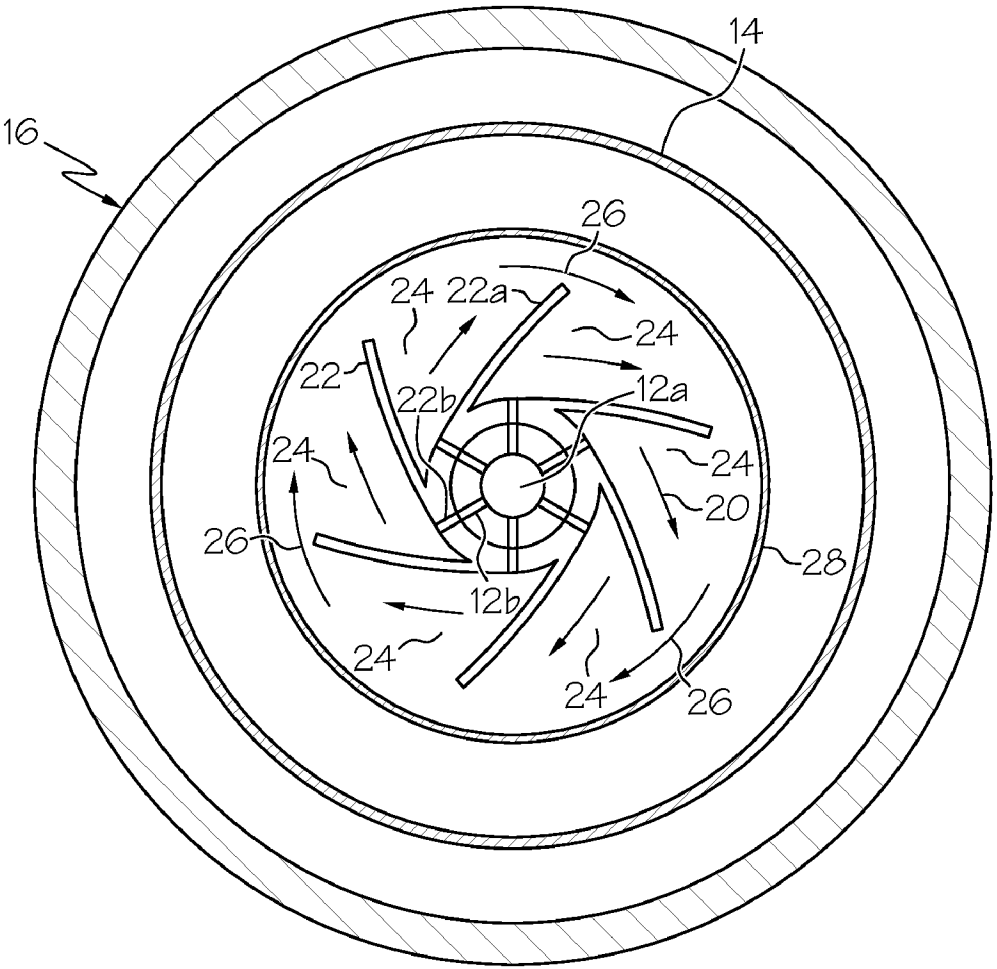
FIG. 2 is a cross sectional view of a portion of the centrifuge of FIG. 1 taken along the line 2-2 showing various features in accordance with the invention.
Figure 3:
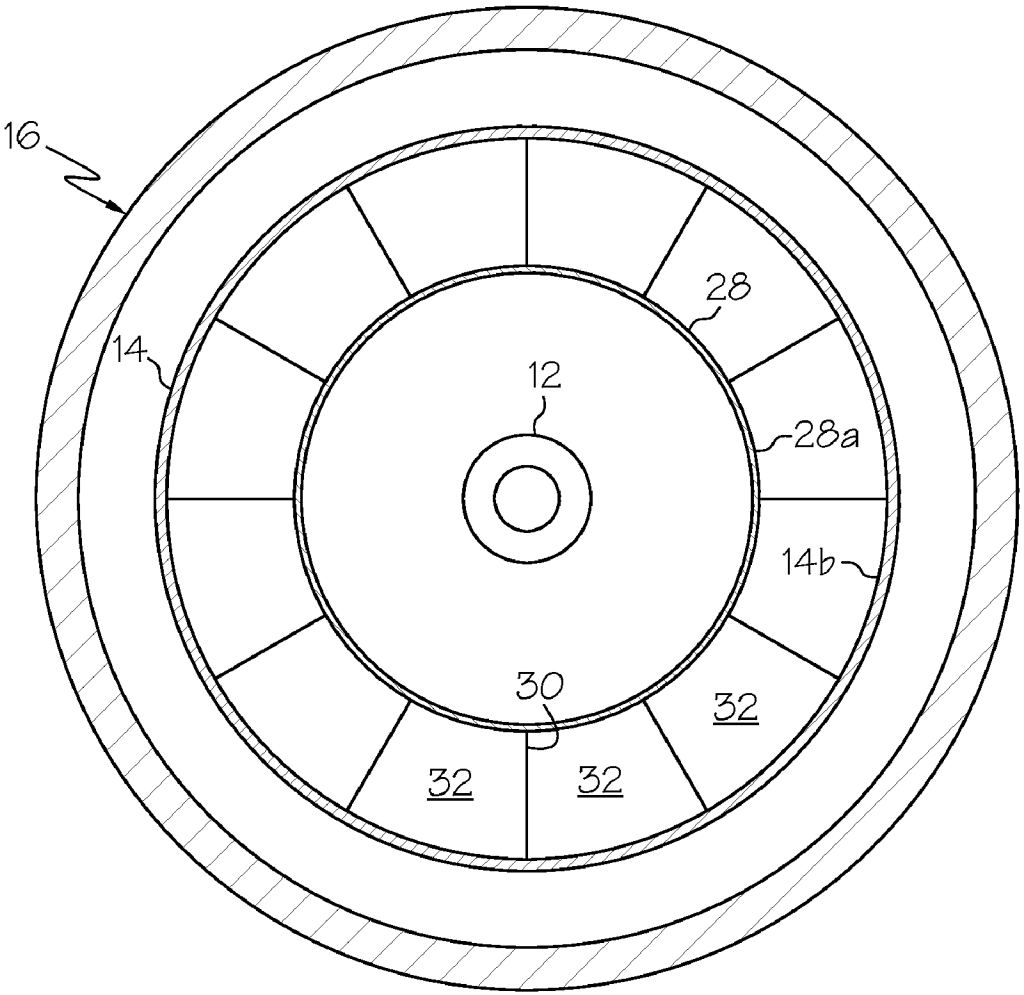
FIG. 3 is a cross sectional view of a portion of the centrifuge of FIG. 1 taken along the line 3-3 showing various features in accordance with the invention.
Figure 4:
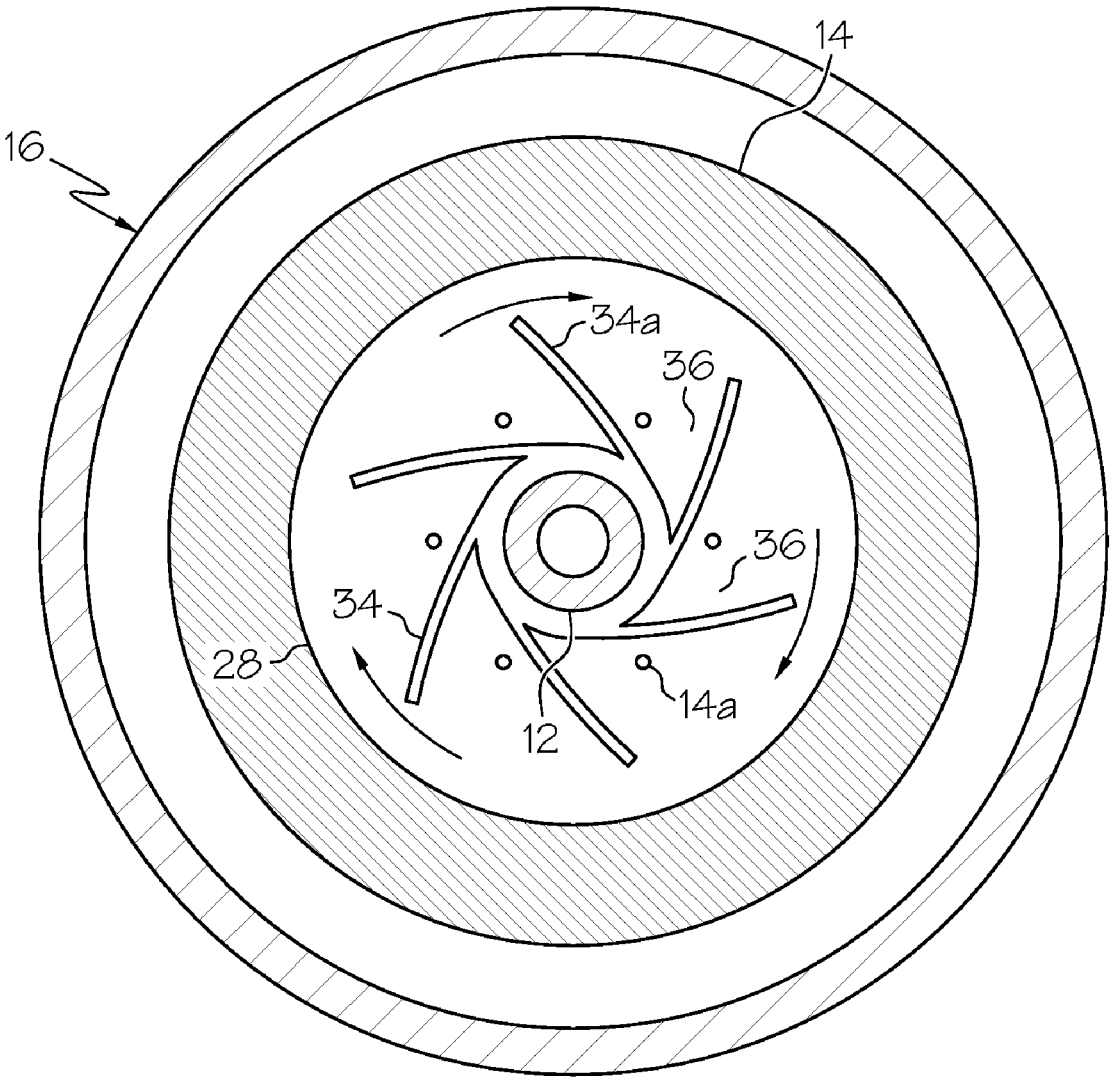
FIG. 4 is a cross sectional view of a portion of the centrifuge of FIG. 1 taken along the line 4-4 showing various features in accordance with the invention.

Operation of the inventive centrifuge 10 may be better understood by referring to cross-sectional FIGS. 2-4.

In FIG. 2, there is shown an inducer 22 that may be attached directly to the spindle 12. The inducer 22 may be comprised of inducer vanes 22*a* and inducer exit ports 22*b*. The inducer exit ports 22*b* may be contiguous with the spindle exit ports 12*b*. The fluid 20 may pass through the ports 12*b* and 22*b* into acceleration regions, designated generally by the numerals 24. Within the acceleration regions 24, direction of the fluid 20 may be gradually changed from a radial flow direction to a tangential flow direction.

It can be seen that this change in flow direction may be made gradually and not abruptly. Fluid 20 emerging from the ports 22*b* may impinge on the inducer vanes 22*a* at an obtuse angle and there may be a gradual change in its direction of flow. The vanes 22*a* may be curved along an arc that generally merges from a radial direction toward a direction that is tangential. Rotational direction of the rotor 14 is shown by arrows designated by the numeral 26. Fluid 20 may be propelled along the vanes 22*a* by internal pressure within the spindle passageway 12*a* and by centrifugal forces produced by rotation of the inducer 22. As the fluid 20 progresses outwardly along the vanes 22*a*, its flow orientation may become substantially aligned with a tangential flow of fluid 20 which may be produced by shear forces of the rotating rotor 14. Fluid 20 thus may enter the rotor 14 without production of vortexes. Consequently the fluid 20 may be introduced into rotor 14 as laminar flow and not turbulent flow.

Referring now to FIG. 3 there is a cross-sectional view taken along the lines 3-3 showing a flow constrainer 28 and flow straighteners 30. The flow constrainer 28 and flow straighteners 30 may be interconnected with the spindle 12 and rotate with the spindle 12. As fluid 20 flows through the rotor 14 it may be constrained to flow between an outer surface 28*a* of the flow constrainer 28 and an inner surface 14*b* of the rotor 14. Additionally, fluid 20 may be constrained to flow in an axial direction by the flow straighteners 30 through a series of rotor passages 32. It can be seen that each passage 32 may be bounded by the flow constrainer 28, the rotor inner surface 14*b* and two adjacent flow straighteners 30.

Cross-sectional areas of the passages 32 may be desirably selected to be consistent with a fluid flow therethrough that corresponds to a Reynolds Number (Re) less than about 1000. A Reynolds Number less than 1000 is typically definitive of laminar, i.e., non-turbulent flow. For any particular fluid flow Re is a function of various parameters in accordance with the following expression:

$$Re=\rho VDe/\mu$$

where $\mu$=Absolute Viscosity of a fluid $\rho$=Density of a fluid

V=Velocity of flow

De=Equivalent Hydraulic Diameter.

Each of the passages 32 may be considered to have an Effective Hydraulic Diameter (De) and De may be chosen to provide a Reynolds Number less than about 1000 for the particular fluid flow passing through the centrifuge 10. In other words spacing between adjacent ones of the flow straighteners 30 and spacing between the flow constrainer 28 and the inner surface 14*b* of the rotor 14 may be selected to assure that a Reynolds Number less than about 1000 is provided for a particular viscosity, density and flow rate of fluid. Thus, for example, the centrifuge 10 may be adapted to provide for soot removal of lubricating oils of various viscosities.

Referring now to FIG. 4, there is shown an exducer 34 that may be attached directly to the spindle 12. The exducer 34 may comprise exducer vanes 34*a*. The exducer 34 may be positioned over the rotor exit ports 14*a*. The fluid 20 may pass through the rotor passages 32 of FIG. 3 into deceleration regions, designated generally by the numerals 36. Within the deceleration regions 36, direction of the fluid 20 may be gradually changed from a tangential flow direction to a radial flow direction.

As in the case of the inducer 22 of FIG. 2, this change in flow direction may be made gradually and not abruptly. Fluid 20 emerging from the passages 32 may impinge on the exducer vanes 34*a* at an obtuse angle and there may be a gradual change in its direction of flow. The vanes 34*a* may be curved along an arc that generally merges away from a direction of rotation of the rotor 14. Fluid 20 may flow along the vanes 34*a* and gradually lose its tangential velocity. As the fluid 20 progresses inwardly along the vanes 34*a*, it passes into the rotor exit ports 14*a* and thus exits from the rotor 14. Fluid 20 thus may exit the rotor 14 without production of vortexes. Consequently the fluid 20 may be removed from the rotor 14 as laminar flow and not turbulent flow.

It should be noted that the centrifuge 10 may be devoid of any elements for prolonging "residence time" of the fluid 20 in the rotor 14. The soot-removal effectiveness of the centrifuge 10 may not be a function of residence time.

Figure 5:
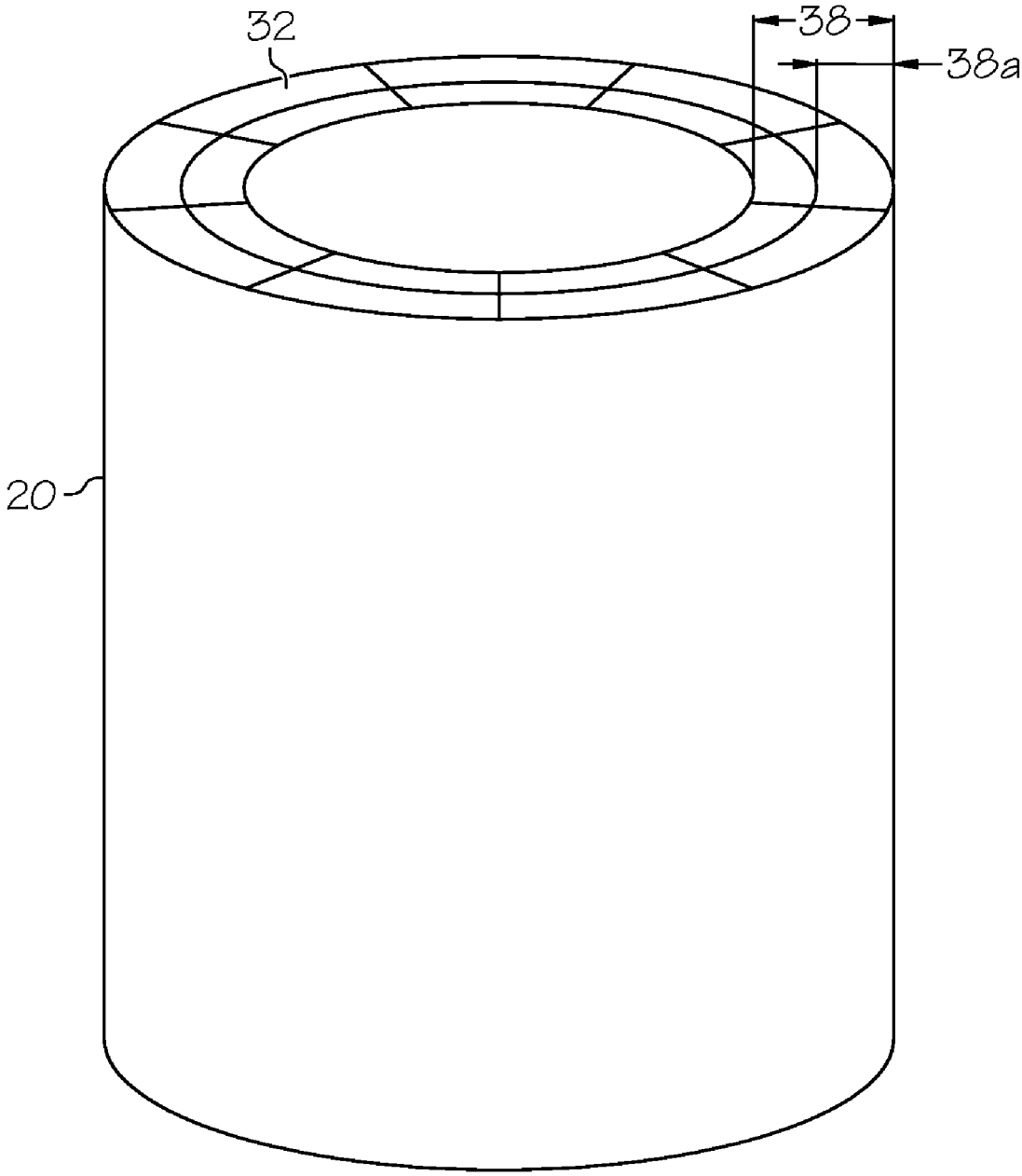
FIG. 5 is a schematic representation of a portion of fluid flowing through the centrifuge of FIG. 1 in accordance with the invention.

This may be better understood by referring to FIG. 5. FIG. 5 is a schematic representation of various regions of fluid 20 that may exist within the passages 32 of the centrifuge 10. A first region may be considered a flow region designated by the numeral 38. The flow region 38 may completely fill the passages 32. The flow region 38 may be considered to have a soot-capturing sub-region or capture region 38*a* during operation of the centrifuge 10. The capture region 38*a* may be adjacent the inner surface 14*b* of the rotor 14. In that regard the inner surface 14*b* may be considered a capture surface.

The fluid 20 passes into and through the passages 32 as a result of incoming pressure at the inlet 16*a* of FIG. 1. As fluid 20 passes through the passages 32, its rate of flow may be determinative of the thickness of the capture region 38*a*. As the rotor 14 of the centrifuge 10 is rotated, centrifugal forces may be applied to soot particles suspended in the fluid 20 within the region 38. Soot particles may be propelled outwardly at a velocity that is a function of the rotational speed and diameter of the rotor 14. For any given rotational speed and diameter, there is a finite rate at which a soot particle may travel radially. Flow rate of the fluid 20 may be determinative of the time during which a soot particle may travel radially while being subjected to the centrifugal force of the rotor 14. If flow rate of fluid 20 were to increase due to, for example, increased pressure at the inlet 16*a*, time for radial soot travel would decrease. As time for radial soot travel decreases, there may be a corresponding diminishment of a distance that a soot particle may travel in a radial direction. The distance that a soot particle may travel radially during transit through the rotor may be considered a capture distance and is represented as the capture region 38*a* of FIG. 2. The capture region 38*a* may have a thickness of about 0.005 inches in a typical one of the inventive centrifuges 10.

The soot-removal effectiveness of the centrifuge 10 may be not merely a function of the size of the capture region 38*a*. As fluid flow rate increases, the capture region 38*a*, of course, becomes thinner and less soot may be collected during axial travel of the fluid 20 through the rotor 14. But, as flow rate increases, there may be an increase in the amount of axial travel of the fluid 20 for any given period of time. In other words there may be an increase in rate of introduction of mass of soot, i.e., flux of soot, into the centrifuge 10 when flow rate increases. This increase of flux of soot has been found to directly offset any diminishment of soot-removal effectiveness produced by a diminishment of thickness of the capture region 38*a*.

In a particular example of operation of the centrifuge 10, the centrifuge was applied to an engine lubrication system in which soot was generated at a rate of about 6 grams/hr. In this example, the centrifuge 10 was about 3 to about 4 inches in diameter and about 7 to about 10 inches long and operated at a speed of about 10,000 to about 12,000 rpm. It was found that an equilibrium concentration of about 1% by weight of small soot particles developed after about 380 hours of operation. In this case the particle size of interest was about 2 μm or less. The lubrication system size was about 40 liters. In other words, this exemplary engine operation proceeded through an initial operation cycle of 380 hours with a small particle (≦2 μm) soot concentration less than 1% and after 380 hours, the soot concentration never exceeded about 1%.

In this context, engine wear from soot may be substantially reduced, as compared with the prior art. Soot particles larger than about 2 μm may be removed from lubrication systems with more conventional filtration devices. But conventional filtration systems typically may not control small particle soot accumulation at an equilibrium concentration. In prior art engines, small particle-soot removal lags behind soot production. There is a gradual buildup of small-particle soot until it becomes necessary to replace the lubricating oil with new oil that is free of soot. Typically, replacement is needed when soot concentration exceeds 1-2%.

The inventive centrifuge 10 may extract small-particle soot at virtually the same rate that it is produced by the engine until an equilibrium concentration of about 1% or less is reached. After that point in time, the centrifuge 10 may control small-particle soot concentration at about 1% or less for an indefinite time.

Figure 6:
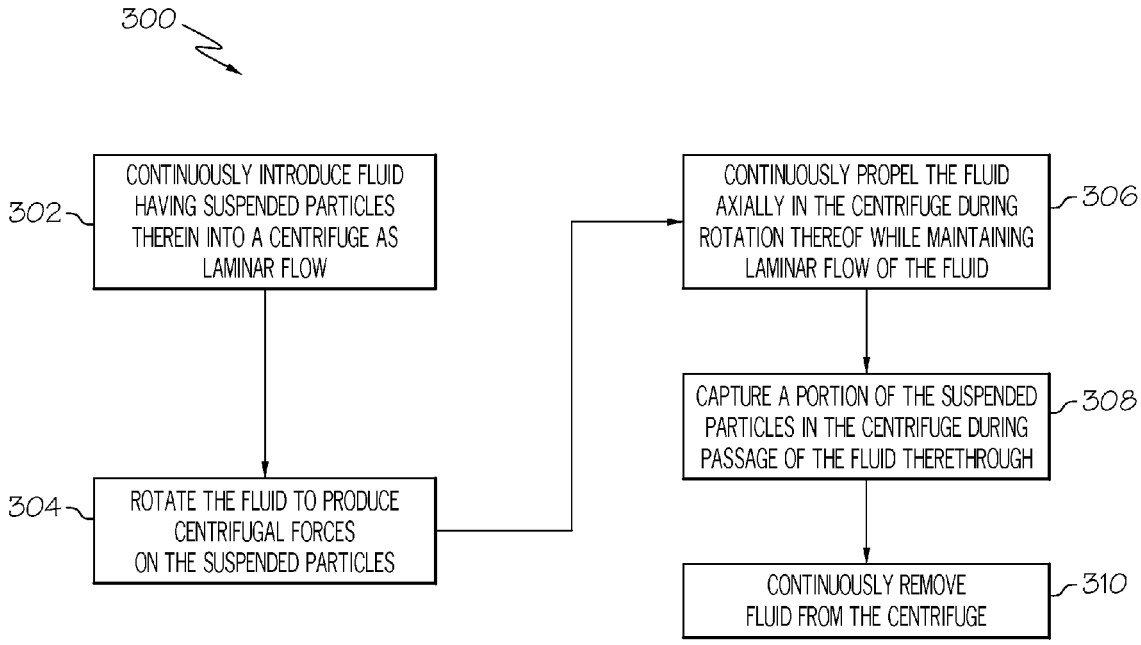
FIG. 6 is a flow chart of a method of collecting particulates from a fluid in accordance with the present invention.

The present invention may be considered a method for removing particulates from the fluid 20. In that regard the method may be understood by referring to FIG. 6. In FIG. 6, a schematic diagram portrays various aspects of an inventive method 300. In a step 302 the fluid 20 with suspended particles therein may be continuously introduced into the centrifuge 10 as a laminar flow. In a step 304, the fluid 20 may be rotated to produce centrifugal forces on the suspended particles. In a step 306 the fluid 20 may be continuously propelled axially in the centrifuge during rotation thereof. Laminar flow of the fluid may be maintained during the axial propelling of the fluid 20. In a step 308 a portion of the suspended particles may be captured during passage of the fluid 20 through the centrifuge 10. In a step 310 the fluid 20 may be continuously removed from the centrifuge 10 in an amount that corresponds to an amount introduced in step 302.

During performance of the method 300 it may be desirable to maintain a flow of the fluid 20 so that a Reynolds number associated with the flow is about 1000 or less. Additionally, it may be desirable to perform the rotating step 304 so that centrifugal forces equivalent to a centrifugal acceleration of about 10,000 g's are applied to the particles.

The method 300 may be particularly useful for capturing small particles of soot that are suspended in lubricating oil of an engine. In that context, the method 300 may be advantageously performed by conducting the rotating step 304 at about 10,000 to about 12,000 rpm. Additionally, the method may be advantageously conducted by performing the capture step 308 at a radius of about 3 to about 5 inches from an axis of rotation of the centrifuge. When employed in this context, the method 300 may provide for an equilibrium concentration of about 1% or less of soot particles less than about 2 μm in an engine lubricating system with a capacity of about 40 liters.

It should be understood, of course, that the foregoing relates to exemplary embodiments of the invention and that modifications may be made without departing from the spirit and scope of the invention as set forth in the following claims.

We claim:

1. A centrifuge for extracting particulates from a continuous flow of fluid, comprising:

a rotor;

a passage for constraining at least a portion of the flow of the fluid as laminar flow;

an inducer with acceleration regions in which direction of the fluid is gradually changed form a radial flow direction to a tangential flow direction, the inducer having a plurality of inducer vanes attached to a spindle, the inducer vanes receiving fluid at an obtuse angle, the inducer vanes being curved along an arc;

spindle exit ports adapted to fluidly connect the spindle with the acceleration regions; and inducer exit ports adapted to receive the fluid from the spindle exit ports and deliver the fluid to the acceleration regions, wherein:

the passage is adapted to direct the laminar flow orthogonally to centrifugal forces imparted to the fluid by rotation of the rotor; and the flow of the fluid is constrained between an outer surface of the passage and an inner constraining surface of the rotor, the inner constraining surface of the rotor being disposed radially outward from the spindle.

2. The centrifuge of claim 1 wherein the fluid flow drives a turbine that imparts rotational force on the rotor and the portion of the flow that is subjected to centrifugal forces comprises about 10% to about 15% of the fluid flow.

3. The centrifuge of claim 1 wherein the passage has an Equivalent Hydraulic Diameter (De) no greater than that which provides for flow of the fluid at a Reynolds number no greater than about 1000.

4. The centrifuge of claim 3 further comprising a plurality of the passages.

5. The centrifuge of claim 1 wherein the rotor has a radius no greater than about 5 inches.

6. A centrifuge adapted to capture soot from lubricating oil comprising:

a rotor with a laminar flow passage therein;

a spindle having a hollow interior for containing the lubricating oil and an exit port;

a plurality of inducer vanes disposed on an inducer for receiving the lubricating oil from the spindle and introducing the lubricating oil into the rotor as laminar flow, the inducer vanes receiving fluid at an obtuse angle, the inducer vanes being curved along an arc; and an exducer for decelerating the lubricating oil within the rotor prior to exit of the fluid from the rotor, wherein:

the laminar flow passage is oriented parallel to an axis of rotation of the rotor;

the flow of the lubricating oil in the laminar flow passage is constrained between an outer surface of the laminar flow passage and an inner constraining surface of the rotor, the inner constraining surface of the rotor being disposed radially outward from the spindle;

the inducer attached to the spindle and adapted to rotate therewith;

the inducer having an inducer exit port contiguous with the spindle exit port; and the inducer having at least two curved inducer vanes with at least one of the vanes positioned so that the inducer exit port is located therebetween, the at least two curved inducer vanes defining a fluid acceleration region therebetween.

7. The centrifuge of claim 6 wherein the inducer vanes are curved along an arc that generally merges from a radial direction to a direction that is tangential to a direction of rotation of the inducer.

8. The centrifuge of claim 6 further comprising a capture surface for soot at an inner surface of the rotor.

9. The centrifuge of claim 6 further comprising a turbine adapted to impart a rotational speed of at least about 10,000 rpm to the rotor.

10. The centrifuge of claim 6 wherein the rotor has a radius no greater than about 5 inches.

11. The centrifuge of claim 6 wherein its axial length is no greater than about 10 inches.

* * * * *